US005818153A

United States Patent [19]

Allen

[11] Patent Number: 5,818,153

[45] Date of Patent: Oct. 6, 1998

[54] SELF-ALIGNED GATE FIELD EMITTER DEVICE AND METHODS FOR PRODUCING THE SAME

[75] Inventor: Philip Charles Allen, Feltham, England

[73] Assignee: Central Research Laboratories Limited, Hayes, England

[21] Appl. No.: 776,540

[22] PCT Filed: Jul. 25, 1995

[86] PCT No.: PCT/GB95/01760

§ 371 Date: Aug. 25, 1997

§ 102(e) Date: Aug. 25, 1997

[87] PCT Pub. No.: WO96/04674

PCT Pub. Date: Feb. 15, 1996

[30] Foreign Application Priority Data

Aug. 5, 1994 [GB] United Kingdom ..... 9415892

[51] Int. Cl.[6] ..... H01J 9/04; H01J 1/30

[52] U.S. Cl. ..... 313/306; 313/309; 313/336; 313/351; 445/24; 445/50; 216/24; 216/25; 438/20

[58] Field of Search ..... 313/306, 309, 313/336, 351, 495; 445/24, 49, 50; 216/24, 25; 438/20

[56] References Cited

U.S. PATENT DOCUMENTS

| | | | |
|---|---|---|---|
| 4,168,213 | 9/1979 | Hoeberechts | 156/659 X |
| 4,943,343 | 7/1990 | Bardai et al. | 156/643 |
| 4,964,946 | 10/1990 | Gray et al. | 156/643 |
| 5,186,670 | 2/1993 | Doan et al. | 445/24 |
| 5,199,917 | 4/1993 | MacDonald et al. | 445/24 |

OTHER PUBLICATIONS

Trujillo et al, "Fabrication of gated silicon field–emission cathodes for vacuum microelectronics and electron–beam applications", Journal of Vacuum Science and Technology: Part B, vol. 11, No. 2, pp. 458–458, XP000364848, Mar. 1993.

Zhang et al, "Integrated silicon process for microdynamic vacuum field emission cathodes", Journal of Vacuum Science and Technology: Part B, vol. 11, No. 6, pp. 2538–2543, XP000423378, Nov. 1993.

R.B. Marcus et al. "Atomically Sharp Silicon and Metal Field Emitters", IEEE Transactions on Electron Devices, vol. 38, No. 10, Oct., 1991.

*Primary Examiner*—Ashok Patel

*Attorney, Agent, or Firm*—Evenson, McKeown, Edwards & Lenahan, PLLC

[57] ABSTRACT

A field emitter and its fabrication method is described in which a gate electrode is formed around and substantially encloses the emitter. The emitter is formed on a silicon substrate and is in the form of a pyramid structure. The surface of the pyramid includes an oxide layer on it. The whole device is baked until the photoresist is drawn, by surface tension, towards the base of the pyramid to expose the metal layer. Etching of the metal layer and the oxide layer produces the finished device which may suitably be employed as a switch in an electronic circuit.

24 Claims, 7 Drawing Sheets

SELF-ALIGNED GATE FIELD EMITTER DEVICE AND METHODS FOR PRODUCING THE SAME

The present invention relates to self-aligned gate field emitter devices and to methods of producing the same and has particular, although not exclusive, relevance to such devices as may be employed as switches in electronic circuits.

The concepts of field emission, i.e. the presence of a very thin barrier potential at a surface from which electrons may migrate, are well known. Numerous devices exist which exhibit field emission. One such example is a sharply pointed substrate such as disclosed in "Atomically Sharp Silicon and Metal Field Emitters", IEEE Transactions on Electron Devices, Vol. 38, No. 10, Oct. 1991. This literature describes a method for producing an atomically sharp silicon tip of less than 10°–15° half-angle. It is known that such sharp tips provide the very thin barrier potential necessary for field emission.

However during the fabrication of a device such as described above, great care needs to be taken to ensure that no damage occurs to the field emitter. This problem will be appreciated because such structures are generally microengineered. This term will be understood by those skilled in the art as meaning that fabrication is conducted on scales of around $1\times10^{-6}$m.

Furthermore if such a device is fabricated with a gate structure, as will generally be the case when the device is to be employed in electronic circuitry, then accurately positioning the gate with respect to the field emitter is an arduous task when the device is microengineered.

It is thus an object of the present invention to at least alleviate the aforementioned problem.

According to a first aspect of the present invention there is provided a self-aligned gate field emitter device comprising: a substrate carrying a tapered protrusion; the tapered protrusion carrying on electrically insulative layer at least partially covering the protrusion, the electrically insulative material extending along the flanks of the tapered protrusion from the base adjacent the substrate towards the tip of the protrusion remote from the substrate; electrically conductive material formed on the electrically insulative layer and extending further towards the tip of the protrusion than the insulative layer and spaced from the protrusion, the tapered protrusion forming the emitter of the device and the electrically conductive material forming the gate of the device, which gate, in operation of the device, provides control for the level of field emission from the emitter, characterized in that electrically conductive material is partially covered by thermoplastic material substantially around the base of the protrusion for supporting the electrically conductive material.

Because the electrically conductive material overlies the electrically insulative material by some way, then a more rigid device is formed by provision of the thermoplastic material around the electrically conductive material.

Advantageously the electrically insulative material is formed by oxidation of the tapered protrusion. This then obviates the need for a separate coating of insulative material. Alternatively it is possible for the insulative material to be an oxide coating formed on the protrusion. Additionally, the protrusion may be formed from the substrate material itself.

According to a further aspect of the present invention there is provided a method of producing a self-aligned gate field emitter device comprising: providing a substrate of material from which the field emitter is to be produced and forming a tapered protrusion thereon; forming, on the surface of the protrusion, electrically insulative material; coating the electrically insulative material with electrically conductive material; at least partially coating the electrically conductive material with thermoplastic material; planarizing the device such that the thermoplastic material remains around the base of the protrusion substantially remote from the tip thereof to at least partially expose the electrically conductive material; selectively removing at least part of the electrically conductive material and the electrically insulative material thereby to define a portion of the device substantially surrounding and enclosing the protrusion characterized in that the planarizing comprises heating the thermoplastic material so that it flows and settles around the base of the protrusion.

The gate is thus actually formed around the emitter and uses the emitter shape as a basis for its formation. Furthermore, because of the geometries employed, it will be apparent that such a technique requires no separate masking to be employed. It will also be apparent that this method allows exposure of the emitter to be prevented until the final steps of the fabrication thus reducing the tendency for it to be damaged.

According to another aspect of the present invention there is provided a method of producing a self-aligned gate field emitter device in accordance with the first aspect of the invention comprising: providing a substrate of material from which the field emitter is to be produced and forming a tapered protrusion thereon; forming, on the tip of the protrusion a cap of the electrically insulative material and further forming on the surface of the protrusion, electrically insulative material; rotating the device about an axis through the tip of the protrusion and substantially perpendicular to the base thereof; coating the electrically insulative material, off-axis, whilst the device is rotating with electrically conductive material; selectively removing at least part of the electrically conductive material and the electrically insulative material, including the cap, thereby to define a portion of the device substantially surrounding and enclosing the protrusion. Thus by coating the protrusion with the electrically conductive material using off-axis rotation coating, it is possible to form the conductive material substantially along the flanks of the protrusion without the need to employ a separate mask.

Preferably the formation of electrically insulative material on the protrusion is achieved by oxidation of the surface of the protrusion. This then obviates the need for a separate coating of insulative material. Alternatively it is possible for the insulative material to be an oxide coating formed on the protrusion. Additionally the protrusion may be formed from the substrate itself.

In accordance with any of the aspects of the present invention, the protrusion may be formed from a semiconductor and this may be at least partially n-type doped. Alternatively, the semiconductor may be n-type doped at the tip and base regions of the protrusion, and p-type doped therebetween.

The invention will now be described, by way of example only with reference to the following drawings, of which:-

Figure 1:
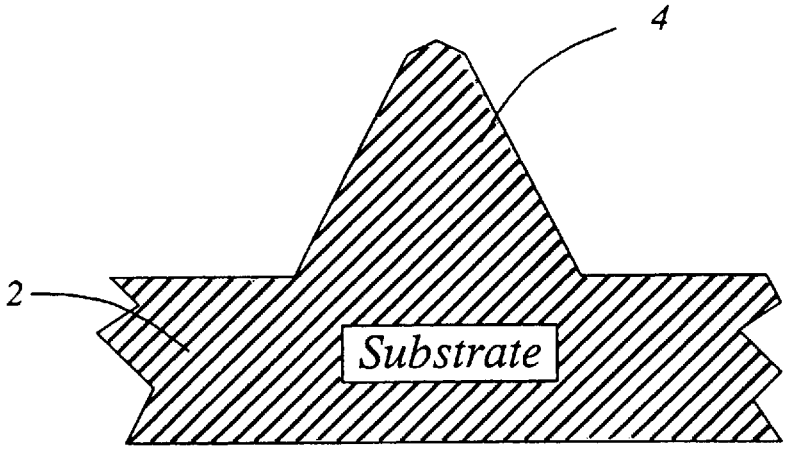
FIG. 1–7 illustrate schematically the fabrication stages of, and a device in accordance with, a first embodiment of the present invention.

By reference firstly to FIG. 1, the basic structure from which a device in accordance with the present invention is fabricated will be seen.

The structure consists of a substrate material 2 which may be chosen to be a semiconductor such as silicon, and supported by the silicon substrate 2 is a tapered protrusion such as the pyramid 4. The pyramid 4 ultimately forms the emitter of the device as will become apparent hereafter. The pyramid 4 may be formed on the silicon substrate 2 by any of several ways, each of which will be readily apparent to those skilled in the art, yet such are not germane to the present invention. For example, the pyramid may be a polished single crystal silicon disc cut on the 100 axis and either formed on, or formed from the silicon substrate. The size of the pyramid 4 from its base to its tip is of the order $8\times10^{-6}$m, although pyramids 4 of any size may be employed.

Figure 2:
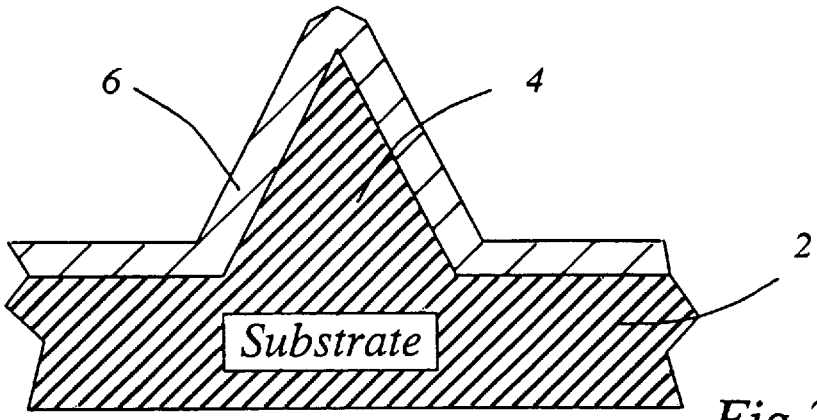

FIG. 2 illustrates the next stage in the fabrication of the device. The pyramid 4 has formed thereon an electrically insulative material such as an oxide layer 6. The oxide layer 6 may be formed either by oxidation of the surface of the pyramid 4 or by coating the pyramid 4 with an oxide. Either of these techniques is equally efficacious and are both well known to those skilled in the art. However, if the oxide layer 6 is formed by oxidation of the pyramid 4, then, as will be seen from FIG. 2, the tip of the pyramid 4 of silicon, per se, will become sharpened by this oxidation. This is advantageous as a separate sharpening of the pyramid 4 tip is then obviated.

Figure 3:
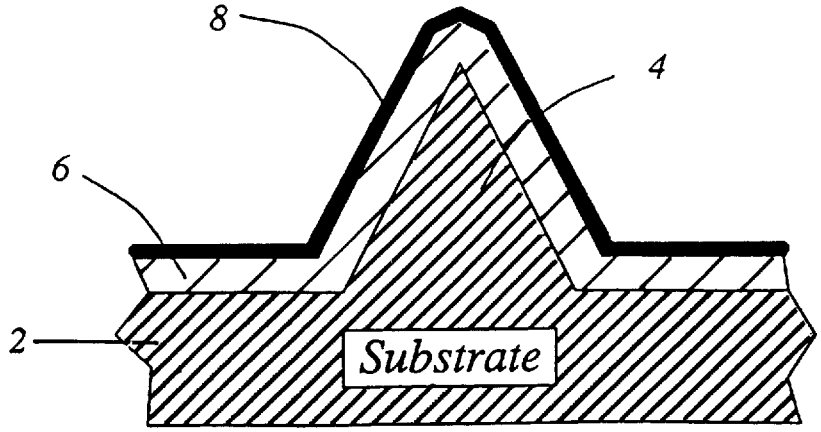

Reference now also to FIG. 3 shows that the oxide layer 6 is coated with electrically conductive material such as metal layer 8. This coating may be applied by any suitable technique, such as sputtering or evaporation.

Figure 4:
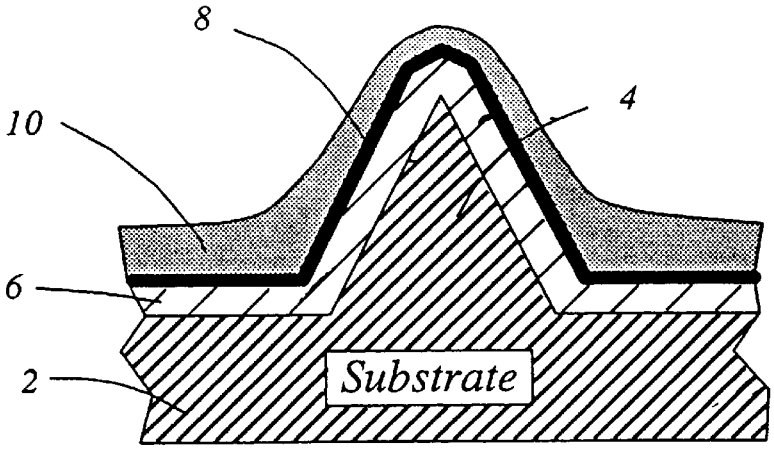

FIG. 4 illustrates that the metal layer 8 is coated with plastics material such a polymer of photoresist 10. In the example of FIG. 4, this photoresist 10 coating covers the metal layer 8 entirely and the photoresist 10 is deposited by any suitable technique, such as spinning.

Figure 5:
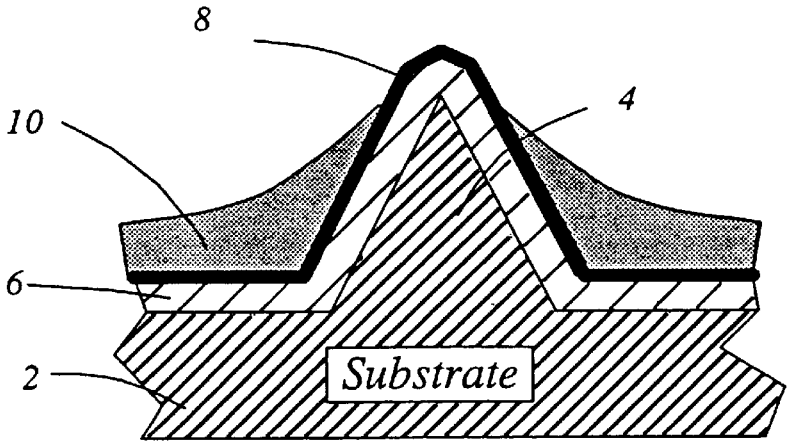

The next stage of the fabrication of the device as shown in FIG. 5 is to bake the entire device until the photoresist 10 is drawn down the pyramid 4 towards its base by surface tension sufficiently to expose the metal layer 8. The degree to which the metal layer 10 needs to be exposed will depend, as will become apparent, upon the spacing ultimately required between the emitter and the gate of the device. In the present example, a temperature of around 140° C. is sufficient to melt a typical positive photoresist material so that the desired effect is achieved.

Figure 6:
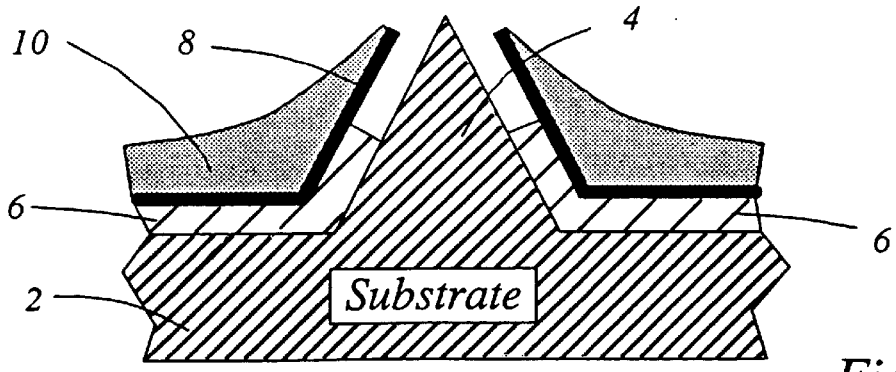

FIG. 6 illustrates the next stage of fabrication of the device in which both the metal layer 8 and the oxide layer 6 are selectively removed to an extent by, for example, etching away. Such removal techniques will be readily apparent to those skilled in the art and hence will not be referred to herein.

It will be seen that the oxide layer 6 is etched away further towards the base of the pyramid 4 than the metal layer 8. This is because, in the finished device, the metal layer 8 will form the gate and needs to be as close as possible to the emitter (formed by the tip of pyramid 4) in order to function effectively. Removal of at least part of the metal layer 8 and the oxide layer 6 also exposes the tip of the pyramid 4. This tip acts as the emitter of the finished device. It will be apparent that the above fabrication stages leave the emitter of the device covered by another material until the final stage of fabrication, thus offering some protection against accidental damage. Furthermore, it will be apparent that the gate region (formed by the metal layer 8) has been automatically formed in self-alignment with the emitter region by virtue of the above fabrication.

Figure 7:
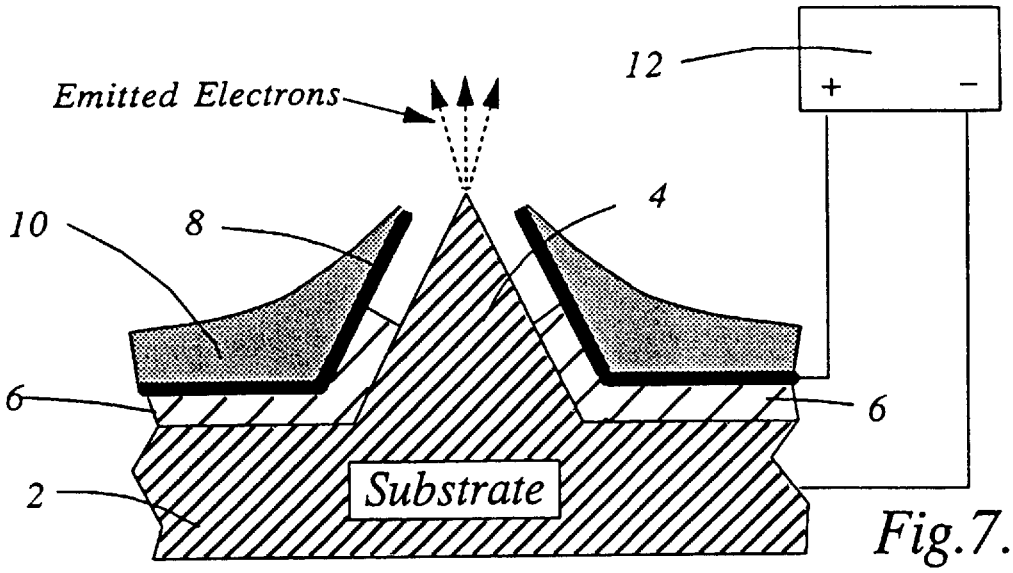

Reference to FIG. 7 illustrates the device described above in use. As has been detailed herebefore, the gate region is formed by the metal layer 8 and the emitter by the pyramid 4. A power supply 12 is arranged to be connected to the emitter and the gate such that the emitter is at a negative potential with respect to the gate, with suitable biassing, electrons will be emitted from the tip of the pyramid 4. The gate, in this example, acts as a control mechanism determining the level of emission current. This is altered by simple adjusting of emission current. This is altered by simply adjusting the difference in potential between the gate and the emitter.

Figure 8:
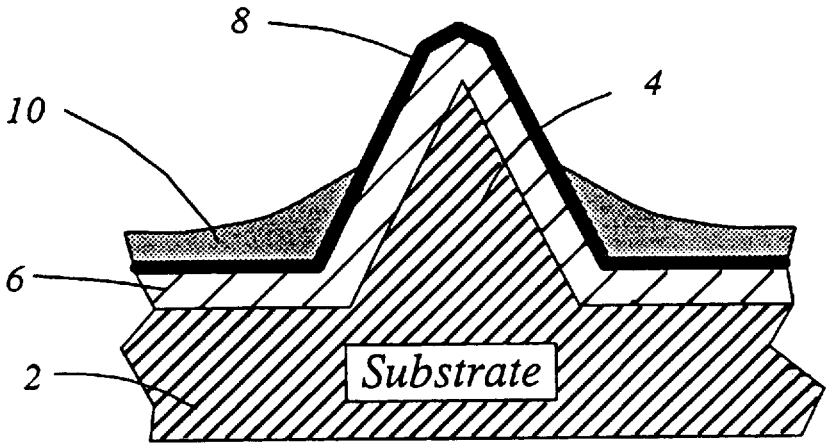
FIGS. 8–11 illustrate schematically the fabrication stages of, and a device in accordance with, a second embodiment of the present invention.

A second embodiment of the present invention will now be described with reference to FIGS. 8–11 in which parts corresponding to those shown in FIGS. 1–7 are correspondingly numbered. The formation of the device up to and including the deposition of the metal layer 8 is as described before. However, the photoresist 10 is deposited in less abundance than previously such that the pyramid 4 stands proud of the photoresist 10 and has a portion of the metal layer 8 exposed. On baking the device, the photoresist, by virtue of surface tension, moves away from the tip of the pyramid 4 to cover only the base region thereof, as is shown in FIG. 8.

Figure 9:
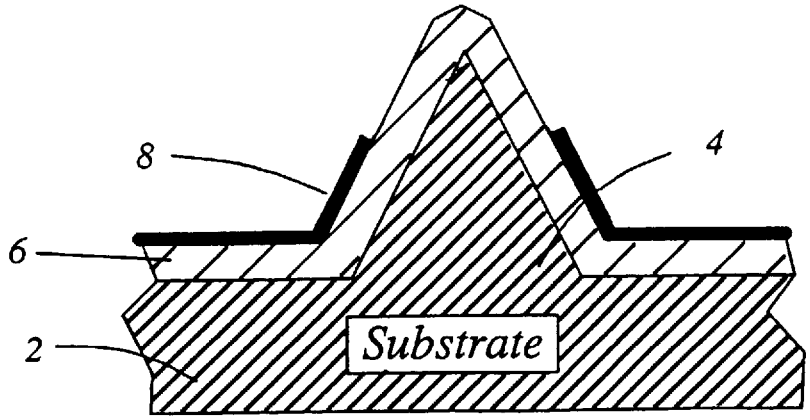
Figure 10:
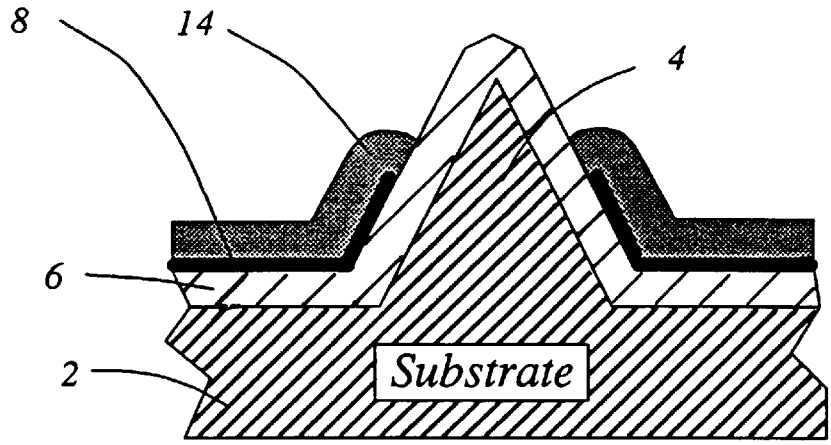

The metal layer 8 is once again selectively removed by, for example, etching and the photoresist 10 is completely removed by washing in a suitable solvent leaving the pyramid 4 bearing the metal layer 8 only at the base as is shown in FIG. 9. Next, a metal plating 14 is formed on the metal layer 8 and at least a part of the oxide layer 6. There are various methods known to those skilled in the art which may achieve this, one such method being utilising the metal layer 8 as the deposition electrode in a metal electroplating bath. Reference to FIG. 10 illustrates the effect of forming the metal plating 14. Finally, as before, the oxide layer 6 is selectively removed by, for example, etching to leave the finished device of FIG. 11. As with the device of FIG. 7, the metal plating 14 of FIG. 11 helps to provide support for the metal layer 8 gate structure in regions where it does not overlie the oxide layer 6 and is separate from the emitter tip, and because the plating 14 is an electrical conductor, will also act as the gate in tandem with metal layer 8.

Figure 12:
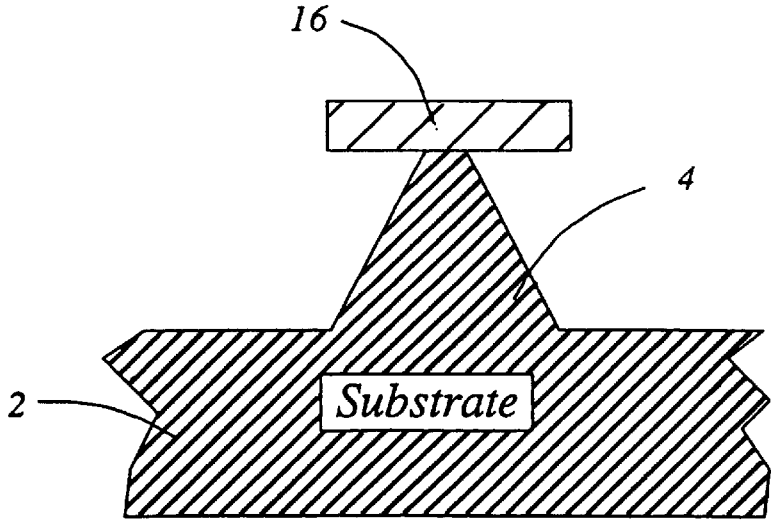
FIGS. 12–15 illustrate schematically the fabrication stages of, and a device in accordance with, a third embodiment of the present invention.
Figure 13:
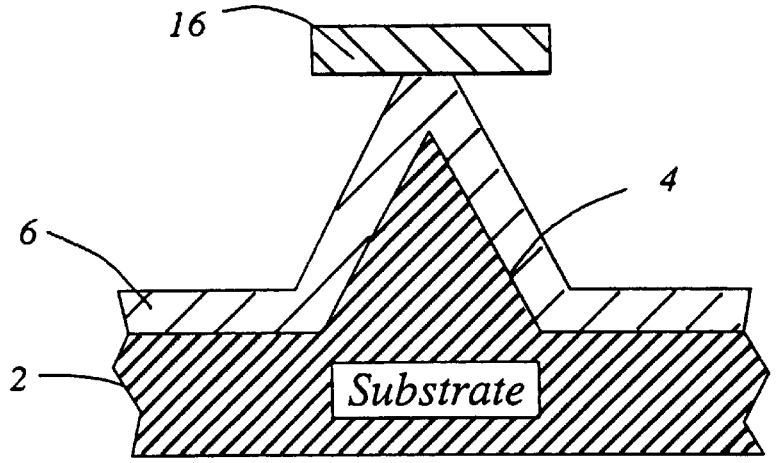

Referring now to FIGS. 12–15, a further embodiment of the present invention will be described. Referring firstly to FIG. 12, the pyramid 4 has formed on its tip, an oxide cap 16. The way in which the cap 16 is formed on the pyramid is not of significance to the present invention and so will not be described herein. Those skilled in the art will be aware of suitable microengineering techniques apt to achieve this structure. Next, as illustrated in FIG. 13, an oxide layer 6 is formed on the surface of the pyramid 4 in the same manner as described above. If the oxide layer 6 is chosen to be formed by oxidation of the silicon, then it will be apparent this process will not effect the cap 16 in anyway, because cap 16 is already an oxide.

Figure 14:
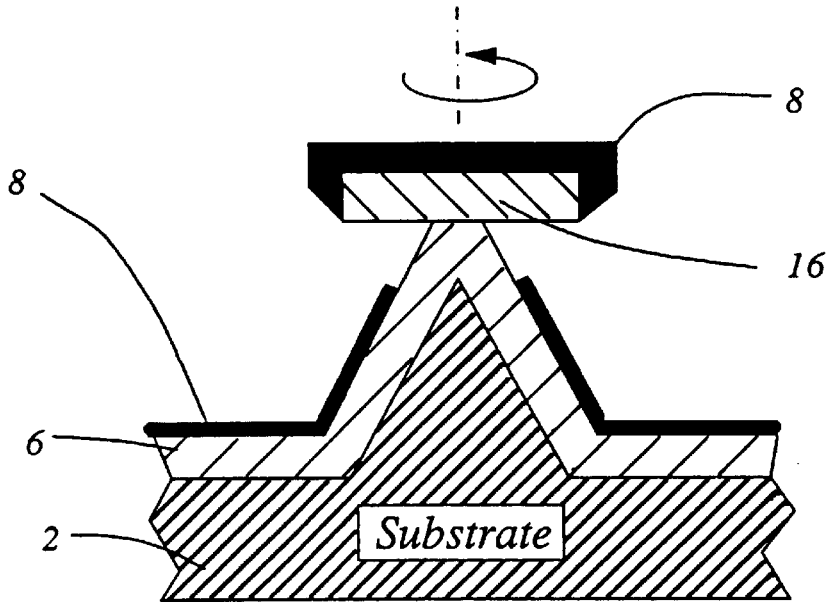

FIG. 14 illustrates the next stage of fabrication in which the whole device is rotated about an axis formed through the pyramid 4 from its tip to a point substantially perpendicular to its base. Thus it will be seen that rotation about this axis results in a rotation of the pyramid 4 about its point of symmetry. As before, a metal layer 8 is coated onto the oxide layer 6. However, it must be noted that the coating must be performed off-axis, as illustrated clearly in the Figure. This is necessary to achieve coating of the oxide layer substantially along the flanks of the pyramid 4. If an on-axis coating were performed, then there would be no metal layer 8 deposited on the flanks of the pyramid 4.

It will be apparent that the source of the coating to provide the metal layer 8 should be of sufficient distance away from the device to provide a substantially collimated beam of coating material. During the coating, the cap 16 acts as a screen to prevent a metal layer 8 being formed around the tip region of the pyramid 4.

Figure 11:
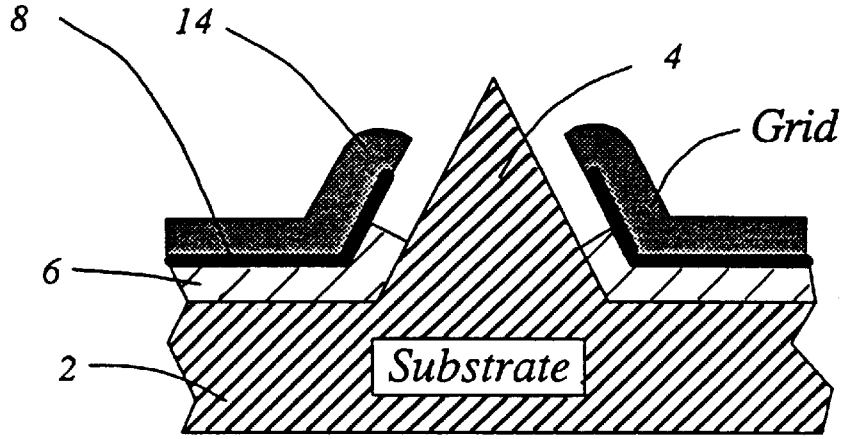
Figure 15:
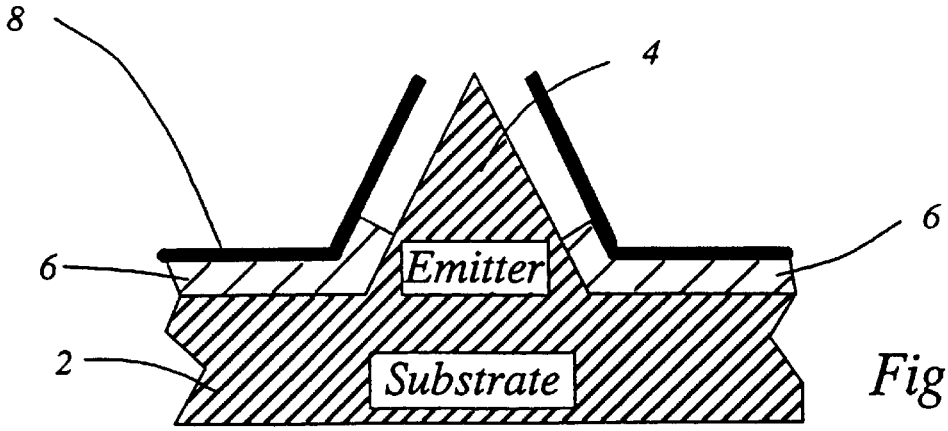

Referring now to FIG. 15, it will be seen that the final stage of fabricating the device is to selectively remove by, for example, etching, the oxide layer 6 and cap 16; this stage being essentially the same as the similar stages described with reference to FIGS. 6 and 11.

Figure 16:
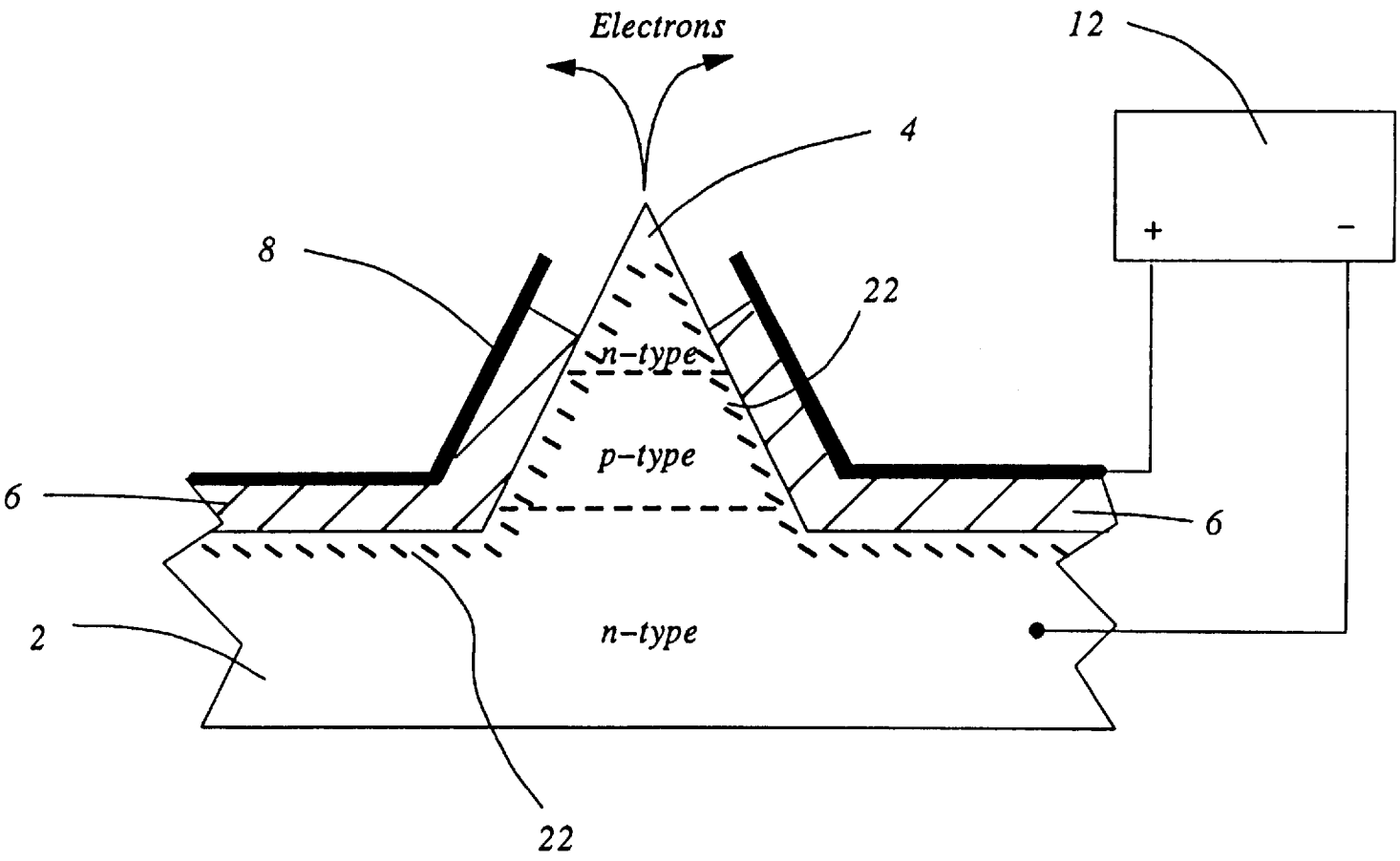
FIGS. 16 and 17 illustrate schematically the doping of a substrate to achieve an electronic switch utilising a device in accordance with the present invention.
Figure 17:
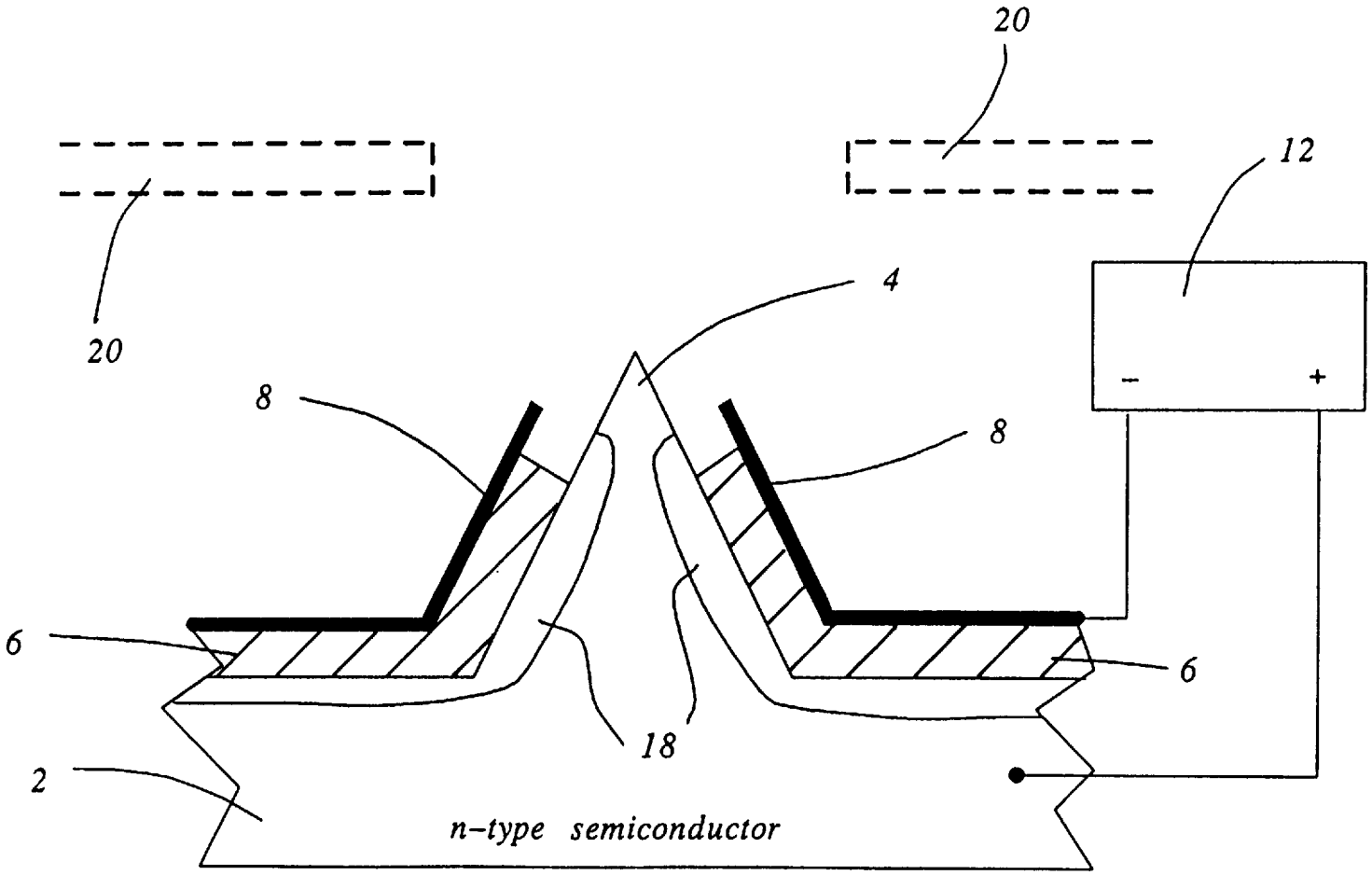

The device and methods for fabrication of the device described above may, as has been detailed, be employed as a switch in an electronic circuit. For this employment, it may be advantageous to dope the substrate material in order to achieve a more efficient switch. Reference to FIGS. 16 and 17 illustrate this.

Referring firstly to FIG. 17, if the final device as, for example, illustrated in FIG. 6 is arranged to have the silicon doped to be n-type, either before, during or after the fabrication, then when the power supply 12 is connected to the gate and substrate regions appropriately, the device may act as a field effect device such as a MOSFET.

Because the gate 8 (formed by the metal layer 8) is, in this example, biassed negatively with respect to the n-type silicon, then a depletion region 18 is set up adjacent the flank surfaces of pyramid 4. The electrons emitted via the tip of pyramid 4 are thus "pinched" through the channel defined by the depletion region, as is standard. The gate 8 thus controls the electron channel. This is, depending on the relative biassing of the gate 8 in relation to the n-type silicon, the width of the electron channel surrounded by the depletion region 18 may be controlled, and hence the rate of efflux of electrons from the tip of the pyramid 4. With the example illustrated in FIG. 16, it will be apparent that an electrode structure 20, positively biassed, is necessary in order to attract the electrons emitted from the tip of pyramid 4, because the gate 8 is negatively biassed.

Referring now to FIG. 16, it will be seen that the tip and base (and the remainder of the silicon substrate) have been doped to be n-type, whilst the region of the pyramid 4 therebetween has been doped p-type. The gate 8 is biassed by power supply 12 to be positive with respect to the silicon. As will be understood with this MOSFET arrangement, the positive gate biassing causes an n-type channel 22 to be formed along the surface of the flanks of pyramid 4. It is along this channel 22 that the electrons are attracted by the attraction of gate 8 and emitted from the tip of the pyramid. Those skilled in the art will appreciate that the structure of FIG. 17 does not require a further separate electrode structure to induce field emission.

By employing a device in accordance with either of FIGS. 16 or 17, an efficient switch is formed as compared generally with the prior art. The reason for this is that by forming the gate 8 substantially along the flanks of pyramid 4, a greater degree of control is exercisable over the movement of charge carriers within those regions of the pyramid 4.

In the above examples, the device has been described by reference to a pyramid. it will be understood that this is merely illustrative of a tapered protrusion, and other structures may equally well be employed, for example cones, needles or the like.

In the above examples, all coatings have been formed completely around the periphery of the pyramid. This is not essential to the present invention. A device in accordance with the present invention function equally well if such coatings are substantially around the periphery of the pyramid. It will be apparent that this still permits the appropriate physical effects to be achieved. Similarly, the degree to which the coatings enclose the pyramid is arbitrary and to be dictated solely by the performance desired in the final device. Thus, for example, the metal mayer may extend up to the tip or only half-way between the tip and the base of the pyramid.

Whilst in the above examples, oxide and metal have been illustrative of an electrical insulator and conductor respectively; it will be appreciated that any suitable material exhibiting the requisite physical properties will suffice.

Furthermore, whilst photoresist has been described as illustrative of a plastics material, any material exhibiting suitable plastics properties, i.e. under the baking action, the material is drawn towards the base of the pyramid by surface tension 80 as to at least partially expose its tip, will suffice.

Whilst the above examples employ microengineering fabrication techniques, it must be appreciated that the tip of the pyramid will have a diameter in the range $10^{-9}$m in order to provide an efficient field emission.

It will be appreciated to those skilled in the art that modifications to the above description are possible whilst still remaining within the scope of the invention, for example, it may be advantageous to have a coating of an oxy-nitride between the oxide and metal layers.

I claim:

1. A self-aligned gate field emitter device comprising: a substrate (2) carrying a tapered protrusion (4); the tapered protrusion carrying on electrically insulative layer (6) at least partially covering the protrusion, the electrically insulative material extending along the flanks of the tapered protrusion from the base adjacent the substrate towards the tip of the protrusion remote from the substrate;

electrically conductive material (8) formed on the electrically insulative layer and extending further towards the tip of the protrusion than the insulative layer and spaced from the protrusion, the tapered protrusion forming the emitter of the device and the electrically conductive material forming the gate of-the device, which gate, in operation of the device, provides control for the level of field emission from the emitter, characterized in that electrically conductive material is partially covered by thermoplastic material (10) substantially around the base of the protrusion for supporting the electrically conductive material.

2. A device according to claim 1 wherein the thermoplastic material is photoresist.

3. A device according to claim 1 wherein the electrically insulative material is formed by oxidation of the tapered protrusion.

4. A device according to claim 3 wherein the tapered protrusion is formed from the substrate material.

5. A device according to claim 1 wherein the electrically insulative material is an oxide coating formed on the protrusion.

6. A device according to claim 1 wherein the electrically conductive material is a metal.

7. A device according to claim 1 wherein the protrusion is a semiconductor.

8. A device according to claim 7 wherein the semiconductor is silicon.

9. A device according to claim 7 wherein the semiconductor is doped to be at least partially n-type.

10. A device according to claim 9 wherein the base and tip regions of the protrusion are n-type and the region therebetween is p-type.

11. A device according to claim 1 wherein the electrically insulative material further forms a cap on the tip of the protrusion.

12. A device according to claim 1 wherein the electrically insulative material is overlaid by a layer of oxy-nitride material.

13. A method of producing a self-aligned gate field emitter device comprising:

providing a substrate of material from which the field emitter is to be produced and forming a tapered protrusion thereon; forming, on the surface of the protrusion, electrically insulative material; coating the electrically insulative material with electrically conductive material;

at least partially coating the electrically conductive material with thermoplastic material;

planarizing the device such that the thermoplastic material remains around the base of the protrusion substantially remote from the tip thereof to at least partially expose the electrically conductive material;

selectively removing at least part of the electrically conductive material and the electrically insulative material thereby to define a portion of the device substantially surrounding and enclosing the protrusion characterized in that the planarizing comprises heating the thermoplastic material so that it flows and settles around the base of the protrusion.

14. A method of producing a self-aligned gate emitter device comprising:

providing a substrate of material from which the field emitter is to be produced and forming a tapered protrusion thereon;

forming, on the tip of the protrusion a cap of the electrically insulative material and further forming on the surface of the protrusion, electrically insulative material;

rotating the device about an axis through the tip of the protrusion and substantially perpendicular to the base thereof;

coating the electrically insulative material, off-axis, with electrically conductive material;

selectively removing at least part of the electrically conductive material and the electrically insulative material, including the cap, thereby to define a portion of the device substantially surrounding and enclosing the protrusion.

15. A method according to claims 13 wherein formation of electrically insulative material on the protrusion is achieved by oxidation of the surface of the protrusion.

16. A method according to claim 13 wherein formation of electrically insulative material on the protrusion is achieved by coating the protrusion with an oxide layer.

17. A method according to claim 13 wherein the selective removing comprises etching of both the electrically conductive material and the electrically insulative material.

18. A method according to claim 17 wherein more electrically insulative material is etched than electrically conductive material.

19. A method according to claims 13 wherein the tapered protrusion is formed from the substrate material.

20. A method according to claim 13 wherein the electrically conductive material is a metal.

21. A method according to claim 13 wherein the protrusion is formed from a semiconductor.

22. A device according to claim 21 wherein the semiconductor is silicon.

23. A method according to claim 21 wherein the semiconductor is doped to be at least partially n-type.

24. A method according to claim 21 wherein the base and tip regions of the protrusion are n-type and the region therebetween is p-type.

* * * * *